US005123876A

United States Patent [19]

McCullough

[11] Patent Number: 5,123,876

[45] Date of Patent: Jun. 23, 1992

[54] ATTIC FAN COVER

[76] Inventor: Fredrick L. McCullough, 209 N. Division, Cleveland, Okla. 74020

[21] Appl. No.: 605,643

[22] Filed: Oct. 30, 1990

[51] Int. Cl.[5] ..... F24F 13/20

[52] U.S. Cl. ..... 454/343; 454/348; 454/349

[58] Field of Search ..... 98/42.04, 42.1, 116, 98/119, 41.3

[56] References Cited

U.S. PATENT DOCUMENTS

| | | | |
|---|---|---|---|
| 2,096,503 | 10/1937 | Allread | 200/54 |
| 3,125,371 | 3/1964 | Krueger | 296/44 |
| 3,130,719 | 4/1964 | Mayer et al. | 126/37 |
| 3,196,814 | 7/1965 | Hahn et al. | 110/18 |
| 3,524,399 | 8/1970 | Bohanon | 98/42.04 X |
| 3,669,041 | 6/1972 | Schworer | 110/18 |
| 4,047,475 | 9/1977 | Cox | 98/116 |
| 4,304,071 | 12/1981 | Obrecht | 49/26 |
| 4,760,773 | 8/1988 | Pezzulli | 98/42.16 |
| 4,945,822 | 8/1990 | Hicks et al. | 98/41.3 |

FOREIGN PATENT DOCUMENTS

| | | | |
|---|---|---|---|
| 810995 | 4/1937 | France | 98/116 |

*Primary Examiner*—Harold Joyce

*Attorney, Agent, or Firm*—Head & Johnson

[57] ABSTRACT

An energy saving cover for use in a building having an opening in a ceiling with an attic fan thereabove, the building having a voltage source, the cover including a horizontal frame attachable to the ceiling below the attic fan opening, a cover panel slidable within the frame between a closed position in which the attic fan is fully covered to substantially reduce the passage of air therethrough and an open position in which the attic fan opening is fully opened, and a switch supported to the frame having an "on" and "off" condition and positioned such that the switch is actuated to the "on" position when the cover is in the fully opened position, the switch being in series with the attic fan motor so that the attic fan motor can be energized only when the cover is in the fully opened position. In a preferred embodiment wherein the building in which the cover is used has an electrically operated heating source, the energy saving cover employs a second switch mounted to the frame and positioned such that the second switch is "on" when the cover is in the fully closed position, the second switch being in series with the heating system whereby the heating system can be actuated only when the cover is in the fully closed position.

7 Claims, 2 Drawing Sheets

ATTIC FAN COVER

BACKGROUND OF THE DISCLOSURE

Many homes in the United States and in other countries of the world have attic fans for improving ventilation. Attic fans are typically placed above an opening in a ceiling in a home and are electrically operated so that when turned "on", air is drawn from the interior of the room in which the fan is positioned and expelled through openings in the attic of the home. Attic fans work efficiently to produce cooling effect within a home. Thus, fresh and usually cooler air is drawn into the home and air is expelled out of the attic, cooling the attic. Since attic fans do not employ any type of refrigeration system, they are economical to operate and in some parts of the country are the only artificial cooling system required for homes.

One problem with attic fans however is that they require a rather large opening in the ceiling of the home in which they are used. This large opening provides the potential for great loss of heat during winter months when the attic fan is not employed. The typical closure of an attic fan, as employed in the United States and other areas, is a system consisting of a series of paralleled louvers. The louvers are balanced in such a way that when the attic fan is turned "on" and starts drawing air, the air causes the louvers to lift to an open position and air freely passes therethrough. When the attic fan is turned "off" and the passage of air therethrough terminates, the louvers fall back to an overlapping, closed position. This arrangement works automatically, however, louvers seldom fit tightly and closely to each other and are normally not formed of insulative type material. Thus, the typical attic fan louver closure system provides an area of great heat loss during winter months.

The purpose of this disclosure is to provide an improved closure for attic fans and particularly an improved closure for attic fans utilized in a home or other building which also includes an electrically operated heating system.

For background information relating to other devices for providing closures for attic fans or the like, see the following previously issued U.S. Pat. Nos. 2,096,503; 3,125,371; 3,130,719; 3,196,814; 3,669,041; 4,304,071 and 4,760,773.

These prior patents show various closure devices or switching apparatuses for use in conjunction with closures, but none show all of the features of the present invention for accomplishing improved energy efficiency in connection with the use of an attic fan.

SUMMARY OF THE INVENTION

This invention provides an energy saving cover for use in a building having an opening in a ceiling with an attic fan thereabove. The opening has a width and a length, and the attic fan has a motor. The building has a voltage source. The invention is most particularly advantageous in a building that also has a heating system utilizing electrical energy. Such heating systems may include a gas, oil fired or coal fired system as well as a totally electrical system, but the invention is useful for any building having an attic fan in which the building heating system is actuated to an "on" or "off" condition in response to an electrical signal.

A horizontal frame having opposed paralleled sidewalls and opposed first and second end walls is attached to the building ceiling directly below the attic fan opening so that the sidewalls are to either side of the opening, and the length of the sidewalls are at least about twice the length of the attic fan opening.

A cover panel, preferably of insulative material, having opposed side edges, is slidably received in the frame sidewalls. The cover panel is slidable to a first position below the ceiling attic fan opening to thereby effectively seal the attic fan opening against the loss of heat from the interior of the building into the building attic. The cover panel is slidable to a second position in which the attic fan opening is fully opened so that when the attic fan is energized, air can freely pass through the opening from the interior of the building into the building attic.

A first switch having an "on" and "off" condition is supported by the frame. The switch has a control element actuated by the position of the cover panel arranged so that it is actuated to the "on" condition when the cover panel is in the second position, that is, when the cover panel is slid to the attic fan opening full open position.

The frame also supports a second switch having an actuating member positioned so that it is engaged by the cover panel and actuated to the "on" position when the cover panel is in the first position, that is, when the cover panel fully and sealably closes the attic fan opening. The second switch is in series with the building electrically controlled heating system so that the heating system can be energized only when the cover panel is in the fully closed position.

Thus, the cover of this invention ensures the saving of energy by reducing the possibility of energy loss through the attic fan opening during cold weather conditions. That is, when a heating system is employed the cover must first fully close the attic fan opening. Further, the attic fan itself can not be operated unless the cover is not in the fully opened position.

A better understanding of the invention will be had by reference to the following description and claims, taken in conjunction with the attached drawings.

DESCRIPTION OF THE PREFERRED EMBODIMENT

Figure 1:
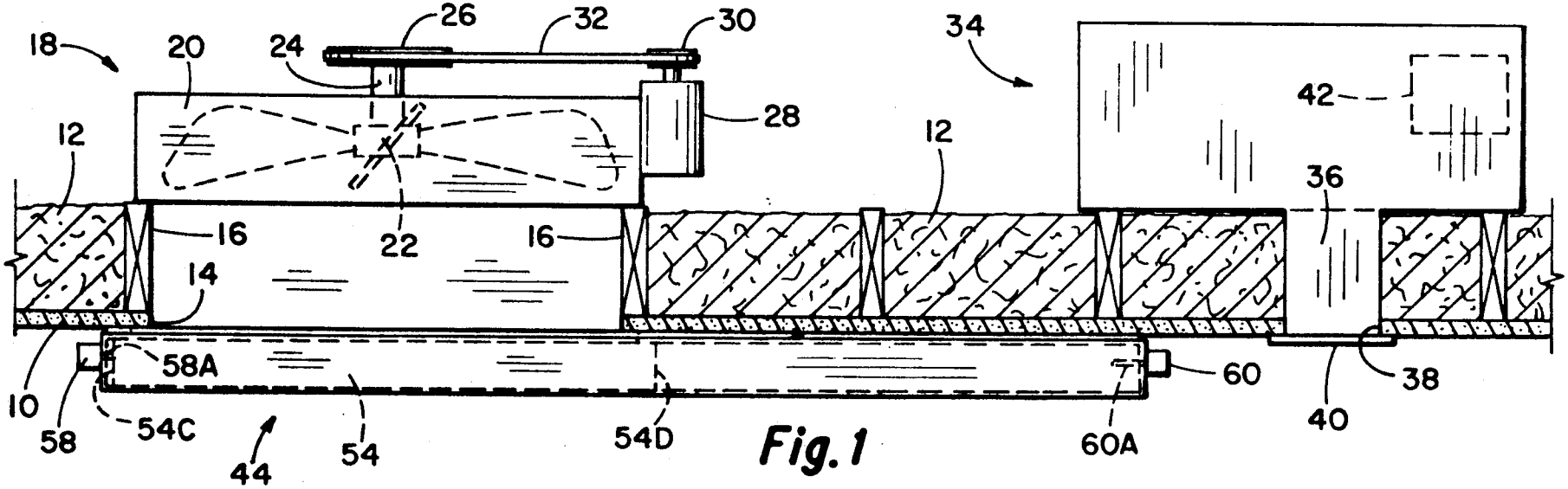
FIG. 1 is an elevational cross-sectional view of a portion of a ceiling of a home or other building that has an attic fan mounted in the attic above the ceiling and including an electrically controllable heating/air conditioning system for heating and/or cooling the interior of the building.

Referring to the drawings and first to FIG. 1, a diagrammatic cross-sectional view of a portion of ceiling in a home or other building is shown, the ceiling being indicated by the numeral 10. Positioned above the ceiling is insulation 12, and the ceiling has an attic fan opening 14 therein mounted on a frame, usually of wood or metal, indicated by the numeral 16. Above ceiling 10 is an attic fan, generally indicated by the numeral 18. The typical attic fan includes: a frame 20; a fan 22 mounted on a shaft 24 having a pulley 26 affixed thereto; a motor 28 which is usually supported to frame 20 which drives a pulley 30; a belt 32 extending from motor pulley 30 to the fan pulley 26. Thus, when motor 28 is energized, fan 22 is rotated to pull air through opening 14 from the interior of the home or building below ceiling 10. The area above the ceiling 10 is normally attic space and below the ceiling 10 is considered living space. Thus, attic fan 18 moves air from the living space into the attic space. In the typical home or building the attic is vented to the exterior so that air is pulled by the attic fan from the living space below ceiling 10 and vented to the atmosphere. The action of the fan thereby serves to draw fresh air into the living space and discharges it through the attic back to the atmosphere.

As previously indicated, attic fan opening 14 affords the possibility of leakage of heat energy during winter conditions wherein it is necessary to warm the living space below ceiling 10. The typical means of closing the attic fan opening is by means of a louver that moves to the open position by force of air drawn therethrough when fan 18 is energized. The louver automatically falling back to the closed, overlapped condition when the attic fan is de-energized. Such louvers provide a generally poor closure system and afford ample opportunity for passage of heat from the living space below ceiling 10 and into the attic through opening 14. The principle objective of this invention is to provide an improved means of closing the attic fan opening 14 to reduce the possibility of heat loss during winter conditions. In addition, the invention provides an improved means of ensuring an effective operation of the building attic fan 18, as well as the building heating/air conditioning system.

Shown in FIG. 1, to the right hand of the attic fan system 18, is a building heating/air conditioning system, generally indicated by the numeral 34. The heating/air conditioning system 34 is emblematic of any type of normal building heating/air conditioning system and may include a gas fired furnace, an oil fired furnace, an electrically operated heat pump, resistance heating or whatever. In addition, the heating/air conditioning system 34 is shown in the attic of the building, that is, above ceiling 10 but this is for purposes of illustration only, as frequently the heating/air conditioning system 34 is mounted in a basement, a closet or a garage, or other area of the home or building. Where the heating/air conditioning system is mounted is irrelevant as to the practice of the present invention and is illustrated as being mounted in the attic only for simplicity of illustration.

The heating/air conditioning system typically includes a duct 36 passing through an opening 38 in the building ceiling, the opening being covered by a grill 40 so that warm air can pass from the heating system into the building. The heating system 34 typically includes some type of electrical control, such as a wall mounted thermostat or other electrically actuated device to turn the heating system 34 "on" or "off". The electrical actuation of the heating system 34 is illustrated as including a motor 42 which, irrespective of the type of energy utilized by the system, is commonly employed for circulating heated air. However, all heating systems do not use a motor 42 and such is by example only, as the principle of this invention is applicable irrespective of the manner in which the heating/air conditioning system 34 employs electrical control for turning the system "on" or "off".

All of the description up to this point is by way of background and to establish the environment in which the present invention is applied. The present invention is an energy saving cover, generally indicated by the numeral 44, that is affixed to ceiling 10 directly below attic fan opening 14. The cover includes a frame (see FIG. 2) which is supported horizontally against ceiling 10. The frame has opposed sidewalls 46 and 48, a first end wall 50 and an opposed or second end wall 52. As shown in the cross-sectional view of FIG. 3, the sidewalls 46 and 48 are in the form of a channel. Slidably moveable in the channel is a cover panel 54 having opposed parallel side edges 54A and 54B which closely but slidably fit inside the channel shaped sidewalls 46 and 48. The cover panel 54 is preferably formed of an insulating material, such as pressed fiber board or the like. The cover panel 54 is manually positionable between an attic fan open position and an attic fan closed position.

The width between sidewalls 46 and 48 is at least equal the width of the attic fan opening 14, and the length of the sidewalls 46 and 48 is preferably at least about twice the length of the attic fan opening 14.

Figure 3:
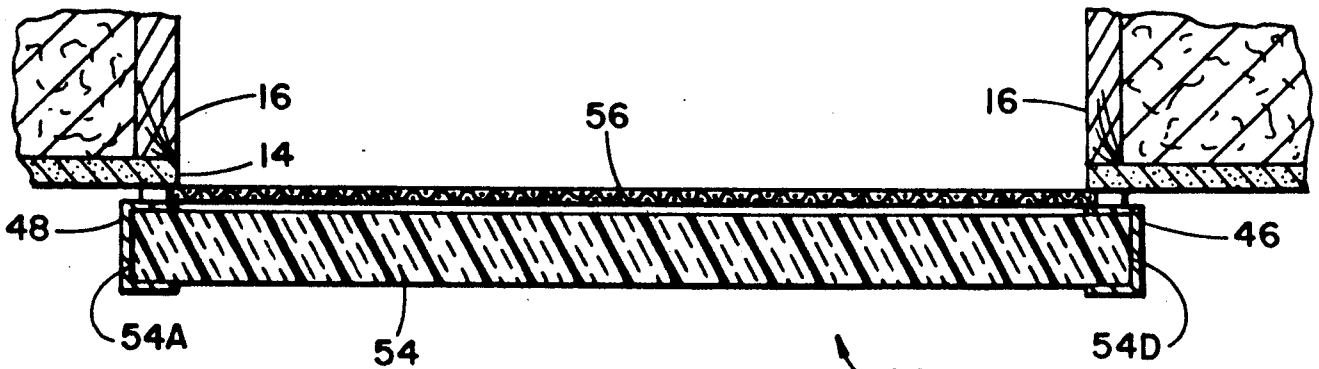
FIG. 3 is a cross-sectional view taken along the line 3—3 of FIG. 2 showing more details of a suggested embodiment of the attic fan cover assembly.
Figures 2, 4:
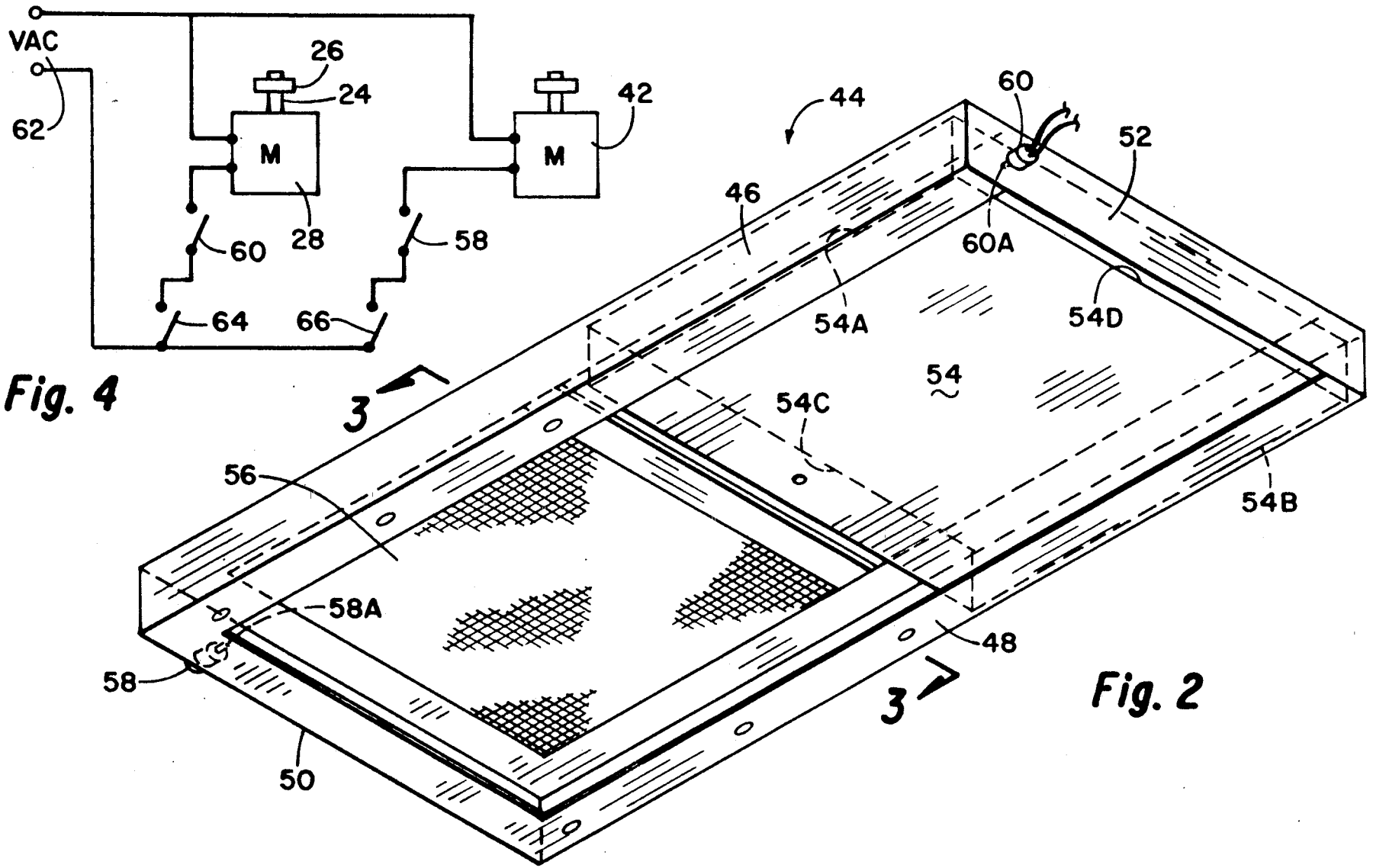
FIG. 2 is an isometric view of an attic fan cover assembly to be mounted on the interior ceiling of a home or other building immediately below an attic fan opening.
FIG. 4 is rudimentary wiring diagram showing the interrelationship between the switches forming a part of the attic fan cover and attic fan motor and the heating/air conditioning system. The wiring diagram also shows the usual wall mounted attic fan switch and thermostat or other wall mounted heating/air conditioning control switch.

As seen in FIGS. 2 and 3, the attic fan cover 44 preferably includes a grill 56 that is fixed, that is, non-slidable, and which is mounted to fully encompass the attic fan opening 14. The grill is supported to the frame sidewalls 46 and 48 and to the first end wall 50 and remains in place to cover the opening 14, but to permit the passage of air therethrough.

Secured to first end wall 50 is a first switch 58 having a control element 58A associated therewith. The first switch 58 is positioned so that the control element 58A is actuated by the cover panel 54. In the illustrated arrangement, the cover panel 54, in addition to the side edges 54A and 54B as previously described, includes a first end edge 54C and a second end edge 54D. The first end edge 54C of the panel actuates first switch control element 58A when cover panel 54 is in the first or closed position, as shown in FIG. 1.

Supported by the second end wall 52 is a second switch 60 having a control element 60A. The second switch 60 is positioned so that control element 60A is actuated by cover panel end edge 54D. Thus, switch 60 is actuated when cover panel 54 is in the second position, as shown in FIG. 2. As thus described, the cover panel 54 has two positions. The first position is shown in FIG. 1 in which cover panel 54 is directly below and sealably closes attic fan opening 14. At the same time, when in such first position, the cover panel actuates first switch 58 to the closed position. The cover panel second position is shown in FIG. 2 in which attic fan opening 14 is fully opened and second switch 60 is actuated.

Referring now to FIG. 4, a rudimentary wiring diagram illustrates the function of switches 58 and 60. A voltage source is indicated by 62. The circuit diagram includes attic fan motor 28 and a heating/air conditioning system motor 42, which is merely representative of any electrically controllable device that is turned "on" and "off". Motor 42 is not intended to represent only a motor but any control apparatus in conjunction with a heating/air conditioning system.

An attic fan switch 64 is typically mounted at a convenient height on a wall in the home or building having the ceiling 10 of FIG. 1, and usually in the vicinity of the attic fan. In the typical home or building as exists today, the attic fan switch is directly connected to turn "on" or "off" motor 28 so that when switch 64 is "on", motor 28 is energized and the attic fan is operated to pull air through opening 14. In the arrangement of FIG. 4, the attic fan switch 64 is connected in series with second switch 60. In this arrangement, when attic fan switch 64 is turned "on", the attic fan motor 28 will not be energized unless the second switch 60 is in the closed condition, which requires cover panel 54 to be in the second, or fully opened position as shown in FIG. 2. This means that attic fan 18 is not operatable unless the cover panel is in the second position, fully exposing attic fan opening 14.

Also shown in FIG. 4 is wall mounted heating/air conditioning switch 66 which may be such as a thermostat or other apparatus for use in turning a heating/air conditioning system "on" "off". This control switch or thermostat 66 is in series with the first switch 58. The switches 66 and 58 are in series with the heating/air conditioning system emblematically represented by motor 42. Thus, it can be seen that the heat/air conditioning system can be operated only when both switches 66 and 58 are closed which, in turn, means that the heating/air conditioning system cannot be actuated unless cover panel 54 is in the first position, as shown in FIG. 1, fully closing the attic fan opening 14.

Thus, as diagrammatically illustrated by the circuit of FIG. 4, the improved attic fan cover herein disclosed ensures improved energy efficiency. First, the attic fan cover prevents inadvertent leakage of heat through attic fan opening 14 when a heating/air conditioning system is being operated since it requires attic fan opening 14 to be fully closed in air-tight manner with insulating cover panel 54. This eliminates the leakage of heating and/or air conditioning as occurs through the typical presently used louvered closure. Second, the system ensures that the attic fan cannot be operated unless and until the cover panel 54 is moved to the second position, fully opening the attic fan opening 14.

First switch 58 may be arranged to include a temperature switch wired to turn heating system 34 "on" "off" in parallel with thermostat 66. Such temperature switch would be pre-set to activate to the "on" condition at a low, above freezing temperature. Thereby, if the occupants of a building are away and a sudden temperature drop occurs, heating system 34 would be activated to prevent the temperature within the house from dropping below freezing, even if the attic fan cover is not closed. The temperature at which such switch would be set is sufficiently low as to be uncomfortable to occupants so that in order to obtain a comfortable temperature the attic fan cover must be closed, closing switch 58. This switch arrangement would prevent damage to the house or other building structure if occupants are away during a drop to below freezing ambient temperature but will encourage them to close the attic fan cover in order to obtain a comfortable temperature during cold wealther conditions.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and more specific use of the terms herein, the more specific meaning is meant. While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An energy saving cover for use in a building having an opening in a ceiling having an attic fan thereabove, the opening having a width and a length, the attic fan having a motor and the building having a voltage source, the cover comprising:

a horizintal frame having opposed paralleled sidewalls and opposed first and second end walls and a top surface, the top surface of the frame being attachable to a ceiling whereby the sidewalls extend below opposite sides of a building attic fan opening, the width between the sidewalls being at least equal the width of the opening and the length of the sidewalls being at least about twice the length of the opening;

a cover panel having opposed paralleled side edges slideably received in said frame sidewalls, the cover panel having opposed end edges, the cover panel being positionable in a first position below and in substantially sealing closure with the ceiling opening and positionable in a second position wherein the opening is fully open;

a switch having an "on" and an "off" condition supported by said frame having a control element actuatable by one of said cover panel opposed end edges, the switch being positioned to be actuated to the "on" condition when said cover panel is in said second position; and circuit means connecting said switch with the attic fan motor and voltage source whereby the attic fan motor can be energized only when said cover panel is in said second position.

2. An energy saving cover according to claim 1 wherein said cover panel is formed at least in part of insulating material.

3. An energy saving cover according to claim 1 for use in a building having a heating system operated, at least in part by electrical energy, comprising:

a second switch having an "on" and "off" condition supported by said frame having a control element actuated by the proximity of an edge of said cover panel, the second switch being positioned to be actuated to the "on" position when said cover panel is in said first position; and circuit means connecting said second switch with said heating system and the voltage source whereby the heating system can be operated only when the cover panel is in said first position.

4. An energy saving cover according to claim 3 wherein said first mentioned switch is positioned on said frame adjacent said first end wall and said second switch is positioned on said frame adjacent said second end wall.

5. An energy saving cover for use in a building having an opening in a ceiling having an attic fan thereabove, the opening having a width and a length, the attic fan having a motor and the building having a voltage source, and the building having a heating system operated, at least in part, by the use of electrical energy; the cover comprising:

a horizontal frame having opposed paralleled sidewalls and opposed first and second end walls and a top surface, the top surface of the frame being attachable to a ceiling whereby the sidewalls extend below opposite sides of a building attic fan opening, the width between the sidewalls being at least equal the width of the opening and the length of the sidewalls being at least about twice the length of the opening;

a cover panel having opposed paralleled side edges slideably received in said frame sidewalls, the cover panel having opposed end edges, the cover panel being positionable in a first position below and in substantially sealing closure with the ceiling opening and positionable in a second position wherein the opening is fully open;

a switch having an "on" and an "off" condition supported by said frame having a control element actuatable by the position of said cover panel, the switch being positioned to be actuated to the "on" condition when said cover panel is in said second position;

first circuit means connecting said switch with the attic fan motor and voltage source whereby the attic fan motor can be energized only when said cover panel is in said second position;

a second switch having an "on" and "off" condition supported by said frame having a control element actuated by the proximity of an edge of said cover panel, the second switch being positioned to be actuated to the "on" position when said cover panel is in said first position; and circuit means connecting said second switch with said heating system and the voltage source whereby the heating system can be operated only when the cover panel is in said first position.

6. An energy saving cover according to claim 5 wherein said cover panel is formed at least in part of insulating material.

7. An energy saving cover according to claim 5 wherein said first mentioned switch is positioned on said frame adjacent said first end wall and said second switch is positioned on said frame adjacent said second end wall.

* * * * *